US007575229B2

(12) United States Patent
Kushida

(10) Patent No.: US 7,575,229 B2
(45) Date of Patent: Aug. 18, 2009

(54) SHEET PROCESSING APPARATUS AND IMAGE FORMING APPARATUS USING SHEET PROCESSING APPARATUS

(75) Inventor: Hideki Kushida, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/183,213

(22) Filed: Jul. 31, 2008

(65) Prior Publication Data

US 2008/0290577 A1 Nov. 27, 2008

Related U.S. Application Data

(63) Continuation of application No. 11/463,177, filed on Aug. 8, 2006, now Pat. No. 7,434,796.

(30) Foreign Application Priority Data

| | | |
|---|---|---|
| Aug. 11, 2005 | (JP) | 2005-233521 |
| Aug. 11, 2005 | (JP) | 2005-233522 |
| Jun. 30, 2006 | (JP) | 2006-180903 |
| Jun. 30, 2006 | (JP) | 2006-180904 |

(51) Int. Cl.
*B65H 37/04* (2006.01)

(52) U.S. Cl. ..... 270/58.08; 270/58.09; 270/58.12; 270/58.17

(58) Field of Classification Search ..... 270/58.08, 270/58.09, 58.12, 58.17
See application file for complete search history.

(56) References Cited

U.S. PATENT DOCUMENTS

| | | | | |
|---|---|---|---|---|
| 5,717,843 | A | 2/1998 | Tabata et al. | 358/1.18 |
| 5,826,158 | A | 10/1998 | Hirano et al. | 399/410 |
| 6,142,353 | A | 11/2000 | Boss et al. | 227/44 |
| 6,308,948 | B1 | 10/2001 | Azumi | 271/207 |
| 6,948,224 | B2 | 9/2005 | Coombs et al. | 29/407.01 |
| 7,014,091 | B2 | 3/2006 | Mochizuki | 227/155 |
| 7,121,540 | B2 | 10/2006 | Machon et al. | 270/52.18 |
| 2005/0082735 | A1 | 4/2005 | Nakamura et al. | 271/1 |
| 2005/0084308 | A1 | 4/2005 | Nakamura et al. | 399/407 |
| 2005/0179190 | A1 | 8/2005 | Kamiya et al. | 270/58.07 |
| 2006/0017209 | A1 | 1/2006 | Kushida et al. | 270/37 |
| 2006/0017218 | A1 | 1/2006 | Kawata et al. | 271/207 |
| 2006/0019811 | A1 | 1/2006 | Ikeda et al. | 493/444 |
| 2006/0279037 | A1 | 12/2006 | Kushida et al. | 270/58.08 |

FOREIGN PATENT DOCUMENTS

| | | |
|---|---|---|
| JP | 2001-220055 | 8/2001 |

*Primary Examiner*—Gene Crawford
*Assistant Examiner*—Leslie A Nicholson, III
(74) *Attorney, Agent, or Firm*—Fitzpatrick, Cella, Harper & Scinto

(57) ABSTRACT

The sheet processing apparatus has a stapling unit which staples a sheet bundle by clinching the sheet bundle, of which sheets sequentially enters an opening between a first stapling part and a second stapling part and are then stacked, and a controller which controls the stapling parts. When executing a stapling process of the sheet bundle, an opening distance between the stapling parts before starting a stapling operation becomes narrower than an opening distance set till the last sheet of the sheet bundle enters (approaches) between the stapling parts. This contrivance enables reduction of the time required for the stapling process of the sheet bundle and an improvement of the productivity irrespective of the number of points for the stapling process without scaling up the apparatus, causing any complicated configuration of the apparatus and increasing the costs.

8 Claims, 8 Drawing Sheets

SHEET PROCESSING APPARATUS AND IMAGE FORMING APPARATUS USING SHEET PROCESSING APPARATUS

This application is a continuation of U.S. patent application No. 11/463,177, Aug. 8, 2006, now pending.

BACKGROUND OF THE INVENTION

1. Field of the Invention

The present invention relates generally to a sheet processing apparatus capable of stapling a sheet bundle at a plurality of points and to an image forming apparatus that uses this sheet processing apparatus. The present invention relate, more particularly, to a sheet processing apparatus and an image forming apparatus that reduce the time required for the stapling process at the plurality of points and improve the productivity without scaling up the apparatus, causing any complicated configuration of the apparatus and increasing the costs.

2. Description of the Related Art

A conventional type of sheet processing apparatus used for an image forming apparatus is exemplified by an apparatus capable of stapling a sheet bundle of which sheets are stacked and aligned on an intermediate processing tray in a way that moves a stapler sequentially to positions corresponding to a plurality of stapling points thereof.

For example, in the case of executing a stapling process of stapling the single sheet bundle at one point of an angular portion of this sheet bundle on the intermediate processing tray, the stapler stands by in a state of being inclined at a predetermined angle in the position corresponding to the predetermined sheet bundle angular portion. Then, the sheet bundle, of which the sheets are aligned on the intermediate processing tray, undergoes the stapling process at one point of the angular portion thereof by the stapler standing by in the angular portion stapling position. The sheet bundle subjected to the stapling process at one point of the angular portion thereof is thus made.

Many of the sheet processing apparatuses have, in the case of carrying out the stapling process of stapling the sheet bundle as described above, a buffering mechanism that is provided an upstream portion of the processing tray and is capable of temporarily storing (buffering) the sheets so as to prevent a new sheet from entering (approaching) the processing tray. For actualizing faster processing, however, there is no alternative but to conduct such intermittent operation control as to temporarily stop an image forming process on the sheet on the side of an image forming apparatus main body and to resume the image forming process after completing the stapling process during a period for which the sheet bundle stapling process is executed within the sheet processing apparatus. Accordingly, in the case of performing the sheet bundle stapling process as described above, such a problem arises that the productivity decreases to a degree corresponding to the time required for this stapling process.

It is considered as a contrivance for reducing the time required for the stapling process to speed up the stapling process in the stapling position of the stapler. Actualization of this speed-up involves power-up of a drive motor related to the stapling by the stapler. In this case, there are considered problems such as cost-up derived from the power-up of the motor, scale-up of the apparatus and a rise in operating sound level.

Moreover, in the case of executing the stapling process at two points of the single sheet bundle on the intermediate processing tray, the stapler standing by in a first stapling position carries out the stapling process at a first point of the sheet bundle aligned on the intermediate processing tray. Subsequently, the stapler is moved to a second stapling position substantially in parallel with an edge portion of the sheet bundler, wherein the same stapling process as the stapling process at the first point is executed in the second stapling position. The sheet bundle undergoing the two-point stapling process is thus made.

The two-point stapling process of the sheet bundle described above is executed by such control operation that the stapler, after stapling the sheet bundle at the first point, moves by a desired pitch along the edge portion of the sheet bundle and repeats the same stapling process at the second point as at the first point. Therefore, such intermittent operation control is conducted that the image forming process on the sheet on the side of the image forming apparatus main body is temporarily stopped and the image forming process is resumed after completing the stapling process during the execution of the two-point stapling process of the sheet bundle within the sheet processing apparatus. Accordingly, in the case of two- or more-point stapling process, the problem arises, wherein the productivity decreases to an extent corresponding to the time required for this stapling process.

It is considered as a contrivance for reducing the time required for this stapling process to (a) speed up a pitch-to-pitch movement of the stapler or the stapling process in the stapling position, or (b) to decrease a moving quantity of the stapler. These methods, however, present the following problems that are to be considered.

To begin with, the actualization of the method (a) involves the power-up of the drive motor related to moving the stapler or the power-up of the drive motor related to the stapling by the stapler. In this case, however, such problems are considered as to cause the cost-up derived from the power-up of the motor, the scale-up of the apparatus and the rise in the operating sound level.

Further, it is considered for actualizing the method (b) that, e.g., two pieces of staplers are provided in the respective stapling positions in order to execute the stapling process at two points without moving the stapler. In this case, however, the number of the staplers must be increased corresponding to the number of the stapling points, and this brings about, it is considered, a problem of resulting in the cost-up.

For others, Japanese Patent Application Laid-Open No. 2001-220055 discloses a technology of reducing the time required for the stapling process. According to the technology disclosed in Japanese Patent Application Laid-Open No. 2001-220055, on the occasion of moving the stapler, the sheet bundle is moved in a direction opposite to a moving direction of the stapler, thereby reducing the time required for the stapling process in a way that decreases a moving distance of the stapler itself. This configuration is effective in reducing the time required for the two-point stapling process but is not effective in reducing the time required for the one-point stapling process. Further, this configuration needs a mechanism for moving an aligning member in synchronization with the pitch-to-pitch movement of the stapler, and hence such problems are considered that the construction gets complicated and the costs rise.

SUMMARY OF THE INVENTION

Under such circumstances, it is an object of the present to improve the productivity by reducing the time required for a stapling process of a sheet bundle irrespective of the number of points for the stapling process without scaling up an apparatus, a complicated configuration of the apparatus and cost-up.

Another object of the invention is to provide above object, according to a representative configuration of the present invention, a sheet processing apparatus including a stapling unit which staples a sheet bundle by clinching the sheet bundle, of which sheets sequentially enter an opening between a first stapling part and a second stapling part and are then stacked; a controller which controls said stapling unit; and an aligning member which aligns the sheets entering said opening, wherein said controller controls said stapling unit to stand by with a first opening distance between said first stapling part and said second stapling part till the last sheet of the sheet bundle enters said opening, and changes the opening distance between said stapling parts into a second opening distance, narrower than the first sheet approach opening, till said aligning member finishes the operation of aligning the last sheet.

A further object of the present invention is to provide a sheet processing apparatus which is capable of executing a stapling process of the sheet bundle at a plurality of points comprising a stapling unit which is movable and staples the sheet bundle in such a way that a first stapling part and a second stapling part clinch the sheet bundle; and a controller which controls said stapling unit, wherein said controller, when stapling the sheet bundle at the plurality of points, controls said stapling unit so that an opening distance between said first stapling part and said second stapling part before starting a stapling operation at a second point becomes narrower than an opening distance before the stapling operation at a first point.

According to the present invention, it is possible to improve the productivity by reducing the time required for the stapling process of the sheet bundle irrespective of the number of points for the stapling process without scaling up the apparatus, the complicated configuration of the apparatus and the cost-up.

Further features of the present invention will become apparent from the following description of exemplary embodiments with reference to the attached drawings.

DESCRIPTION OF THE EMBODIMENTS

Figure 1:
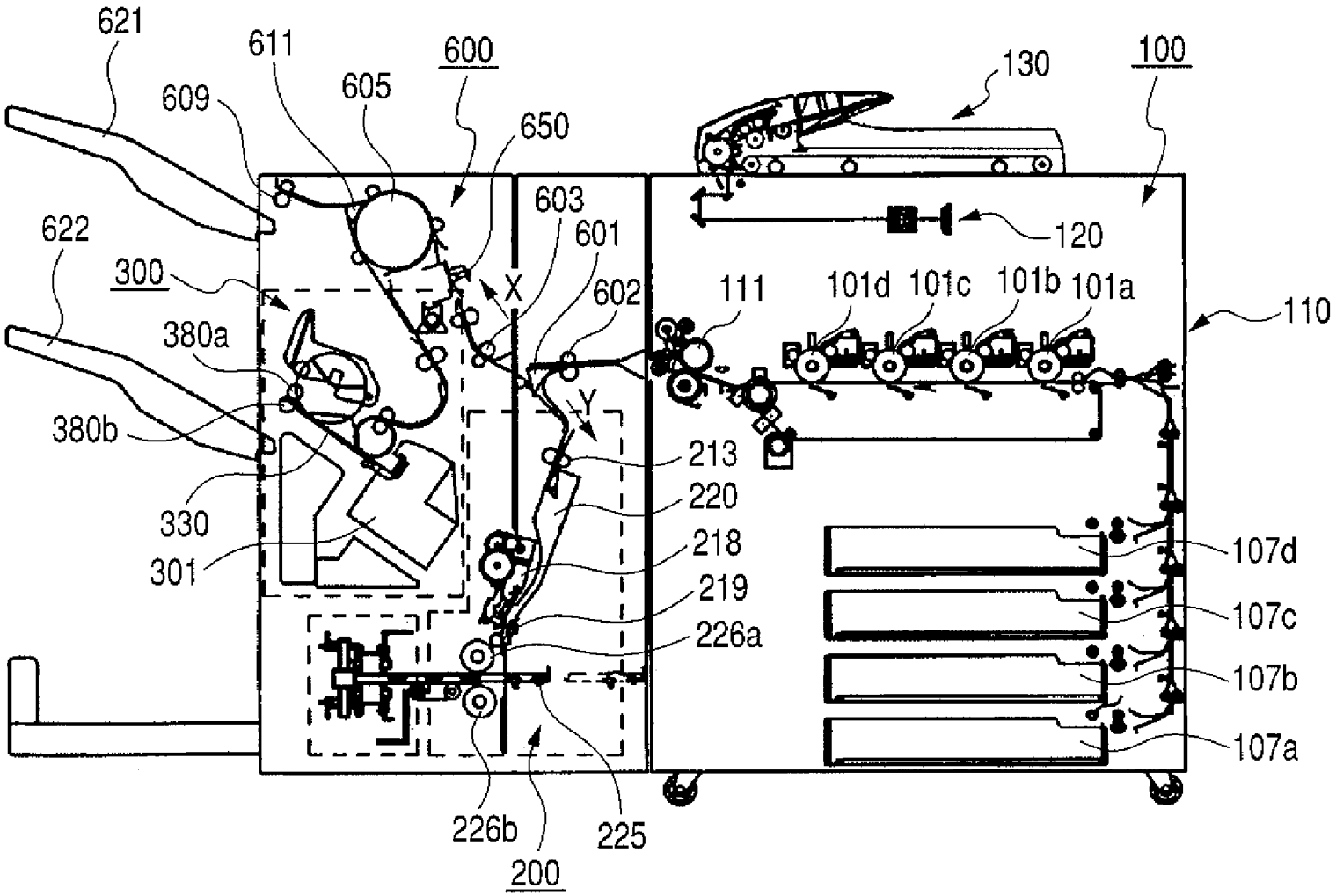
FIG. 1 is a schematic sectional view of an image forming apparatus including a sheet processing apparatus.

Preferred embodiments of the present invention will hereinafter be described in detail in an exemplificative manner with reference to the drawings. FIG. 1 is a schematic sectional view of an image forming apparatus including a sheet processing apparatus according to the embodiment of the present invention.

The image forming apparatus depicted in FIG. 1 is constructed of a black-and-white/color image forming apparatus main body 100 and a finisher 600 serving as the sheet processing apparatus including a saddle stapling processing portion 200 and a side stapling processing portion 300. The image forming apparatus main body 100 is constructed of an image reading device 120 and a printer 110, and a document feeding device 130 is attached to the image reading device 120. Images of the documents (originals) separated and thus fed sheet by sheet by the document feeding device 130, are read by the image reading device 120.

Sheets selectively fed from cassettes 107*a*-107*d* within the image forming apparatus main body 100 are fed into an image forming portion. In the image forming portion, toner images in yellow, magenta, cyan and black are formed respectively on individual photosensitive drums 101*a*-101*d*. Then, the 4-color toner images are sequentially transferred in superposition onto the sheets from the photosensitive drums 101*a*-101*d* and are fixed by a fixing device (fixer) 111, and the toner-image-transferred sheets are discharged outside the apparatus main body. The sheets discharged from the image forming apparatus main body 100 are sent to the finisher 600.

The finisher 600 sequentially captures the sheets discharged from the image forming apparatus and can execute a predetermined process selectively. The finisher 600 according to the present embodiment is capable of executing a punch process of punching out holes in the vicinity of trailing ends of the captured sheets. Further, the finisher 600 is also capable of executing an aligning process of bundling (stacking) the plurality of captured sheets into one bundle by aligning the edges of these sheets, and a side stapling process of stapling the trailing end of the stacked sheet bundle. In the present specification, the sheet alignment connotes, e.g., aligning the edge portions of the sheets of the sheet bundle. The finisher 600 is further capable of executing an aligning process of stacking the plurality of captured sheets into one bundle in a way that aligns the edges of the plural sheets, a saddle stapling process of stapling the center of the stacked sheet bundle, and a folio process of folding in folio the saddle-stapled sheet bundle. Note that though capable of carrying out a sort process of sorting the sheets of the sheet bundle and thus discharging the sheets and a non-sort process of discharging the sheets without sorting sheets of the sheet bundle, these processes are the well-known techniques and are therefore omitted in their detailed explanations herein.

The finisher 600 has a pair of inlet rollers 602 for guiding the sheets discharged from the image forming apparatus main body 100 into an interior. A first changeover flapper 601 for guiding the sheets to a side stapling binding path X or a saddle stapling binding path Y is provided downstream of the pair of the inlet rollers 602.

To being with, an operation of the side stapling processing portion 300 will briefly be described. The sheets guided to the side stapling binding path X are fed toward a buffer roller 605 via a pair of conveyance rollers 603. The conveyance rollers 603 and the buffer roller 605 are so constructed as to be rotatable in forward and reversed directions.

It is to be noted that a punch unit 650 is provided between the conveyance rollers 603 and the buffer roller 605. The punch unit 650 operates as the necessity may arise and punches out the holes in the vicinity of the trailing ends of the conveyed sheets.

The buffer roller 605 is a roller capable of being wound with a plurality of sheets fed to its outer periphery in a way that laminates a predetermined number of sheets thereon. The sheets wound on the buffer roller 605 are guided toward a sample tray 621 by the second changeover flapper 611 disposed downstream or guided toward an intermediate tray (hereinafter referred to as a processing tray) 330 within the side stapling processing portion 300.

The sheets guided toward the sample tray 621 are discharged and stacked on the sample tray 621 by a pair of second discharge rollers 609.

The sheets guided toward the processing tray 330 are discharged and stacked on the processing tray 330 by a pair of first discharge rollers 320. The sheets stacked on the processing tray 330 undergo the aligning process, the side sapling process, etc according to the necessity, and are thereafter discharged onto a stack tray 622 by a pair of the bundle discharge rollers 380 consisting of a lower bundle discharge roller 380*a* and an upper bundle discharge roller 380*b*. The stapling process of stapling the sheets stacked in bundle on the processing tray 330 involves using a stapler 301 serving as a stapling unit, wherein the stapling process of stapling an angular portion and a back portion of the sheet bundle is conducted. Note that an in-depth description of a series of side stapling processes by the stapling unit including this stapler 301 will be made later on.

Next, an operation of the saddle stapling processing portion 200 will briefly be explained. The sheets guided to the saddle stapling binding path Y are housed in a housing guide 220 by a pair of conveyance rollers 213 and further conveyed till leading edges of the sheets abut on a movable sheet positioning member. Further, two pairs of staplers 218 are provided in positions midway of the housing guide 220 and are constructed to cooperate with anvils 219 facing these staplers so as to staple the center of the sheet bundle.

A pair of folding rollers 226*a*, 226*b* is provided in a downstream position of the staplers 218. A protruded member 225 is provided in a face-to-face position with the folding rollers 226. In the case of folding the sheet bundle stapled by the staplers 218, the sheet positioning member is descended a predetermined distance so that the sheet bundle stapling position is set in the central position of the pair of the folding rollers 226 after finishing the stapling process. Next, the protruded member 225 is protruded toward the sheet bundle, whereby this sheet bundle is extruded in between the folding rollers 226 and turns out to be the saddle stapling binding bundle folded in folio by the folding rollers 226.

Next, a configuration and an operation of the side stapling processing portion 300 in the finisher 600 will be explained in detail. The side stapling processing portion 300 includes the stapling unit having the stapler 301 and a processing tray unit including the processing tray 330.

Figure 7:
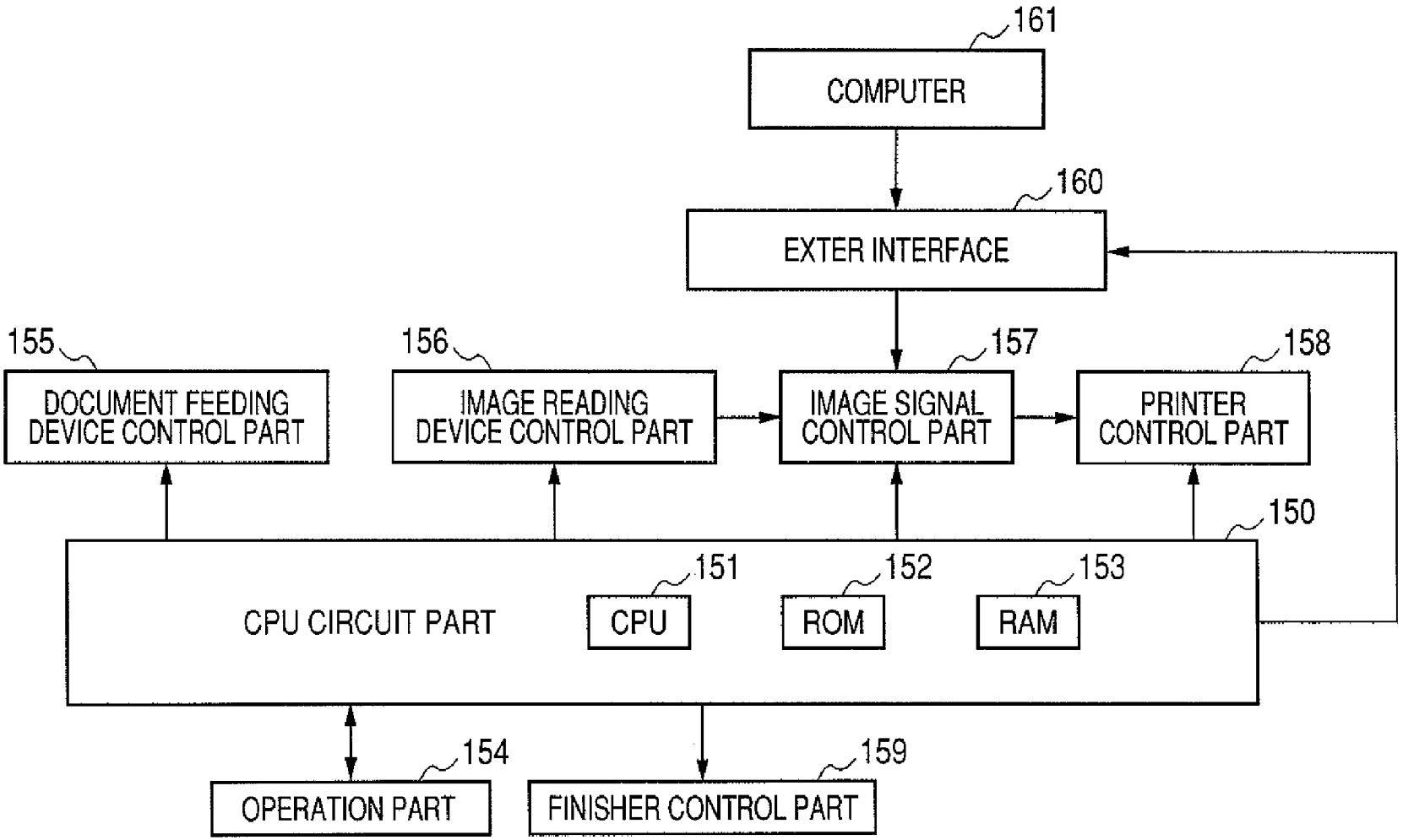
FIG. 7 is a block diagram showing a configuration of a controller that controls a whole image forming apparatus.

Herein, a configuration of a controller that controls the whole image forming apparatus will hereinafter be described with reference to the drawings. FIG. 7 is a block diagram showing the configuration of the controller that controls the whole image forming apparatus in FIG. 1.

The controller has, as illustrated in FIG. 7, a CPU circuit part 150 including a CPU 151, a ROM 152 and a RAM 153. Then, the CPU circuit part 150 controls in a unified manner, based on a program stored in the ROM 152 and setting of an operation part 154, a document feeding device control part 155, an image reading device control part 156, an image signal control part 157, a printer control part 158, a finisher control part 159 and an external interface 160. The document feeding device control part 155 controls the document feeding device 130, the image reading device control part 156 controls the image reading device (image reader) 120, the printer control part 158 controls the printer 110, and the finisher control part 159 controls the finisher 600, respectively. It should be noted that the present embodiment exemplifies the configuration of how the finisher 600 is controlled through the finisher control part 159, however, the finisher 600 may also be controlled directly by the CPU circuit part 150 on the side of the image forming apparatus.

The RAM 153 is employed as an area for temporarily storing control data and as an operation area for computing involved in the control. The external interface 160 is an interface with a computer 161 and outputs print data to the image signal control part 157 in a way that develops the print data into images. The images read by an image sensor are outputted to the image signal control part 157 from the image reading device control part 156, and the images outputted to the printer control part 158 from the image signal control part 157 are inputted to an exposure control part.

Figure 2:
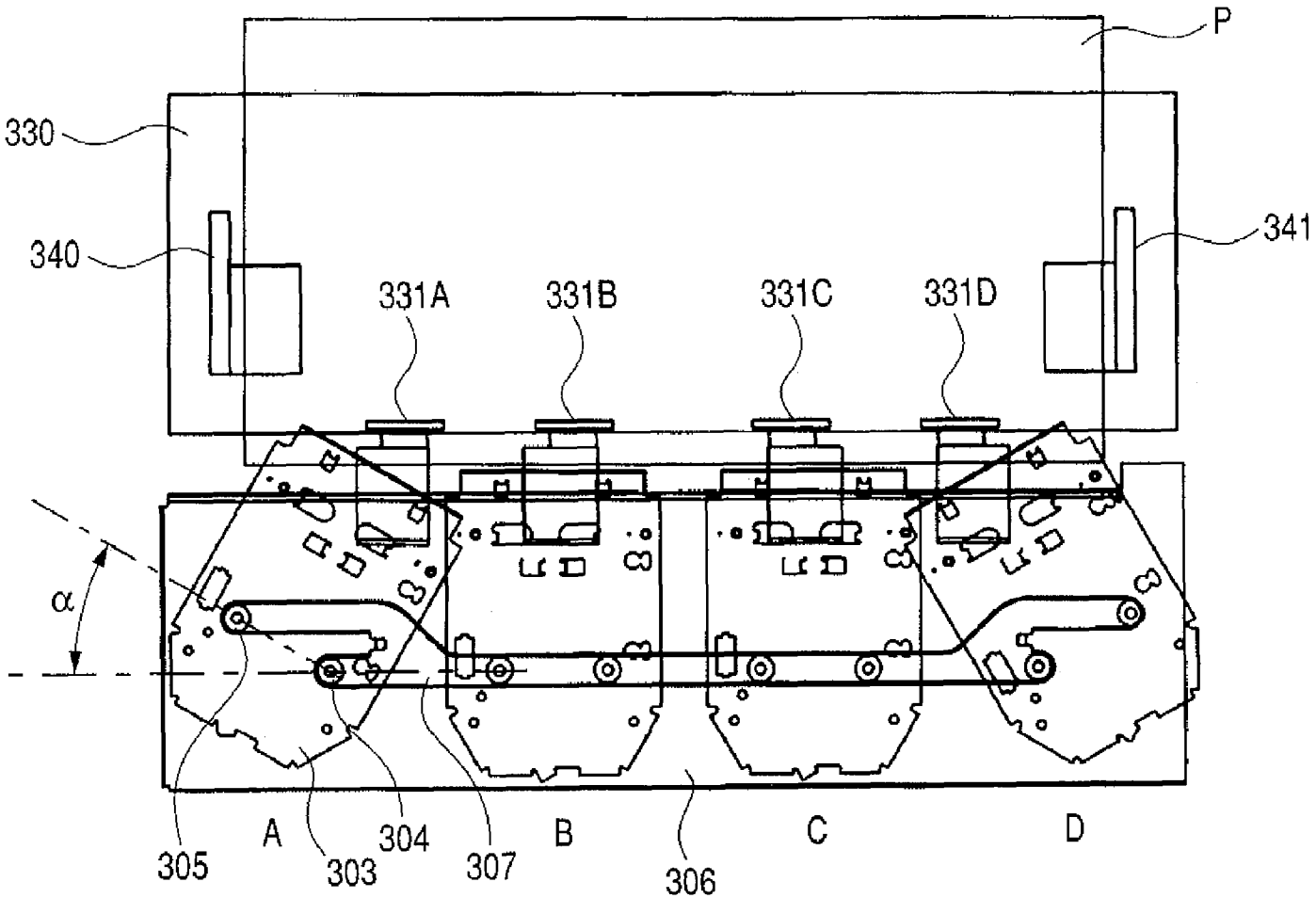
FIG. 2 is a schematic top view of a saddle stapling processing part in the sheet processing apparatus.

To start with, the stapling unit of the side stapling processing portion 300 will be explained by use of FIGS. 2 and 3. FIG. 2 is a top view of the stapling unit, and FIG. 3 is a front view of the stapling unit.

Figure 3:
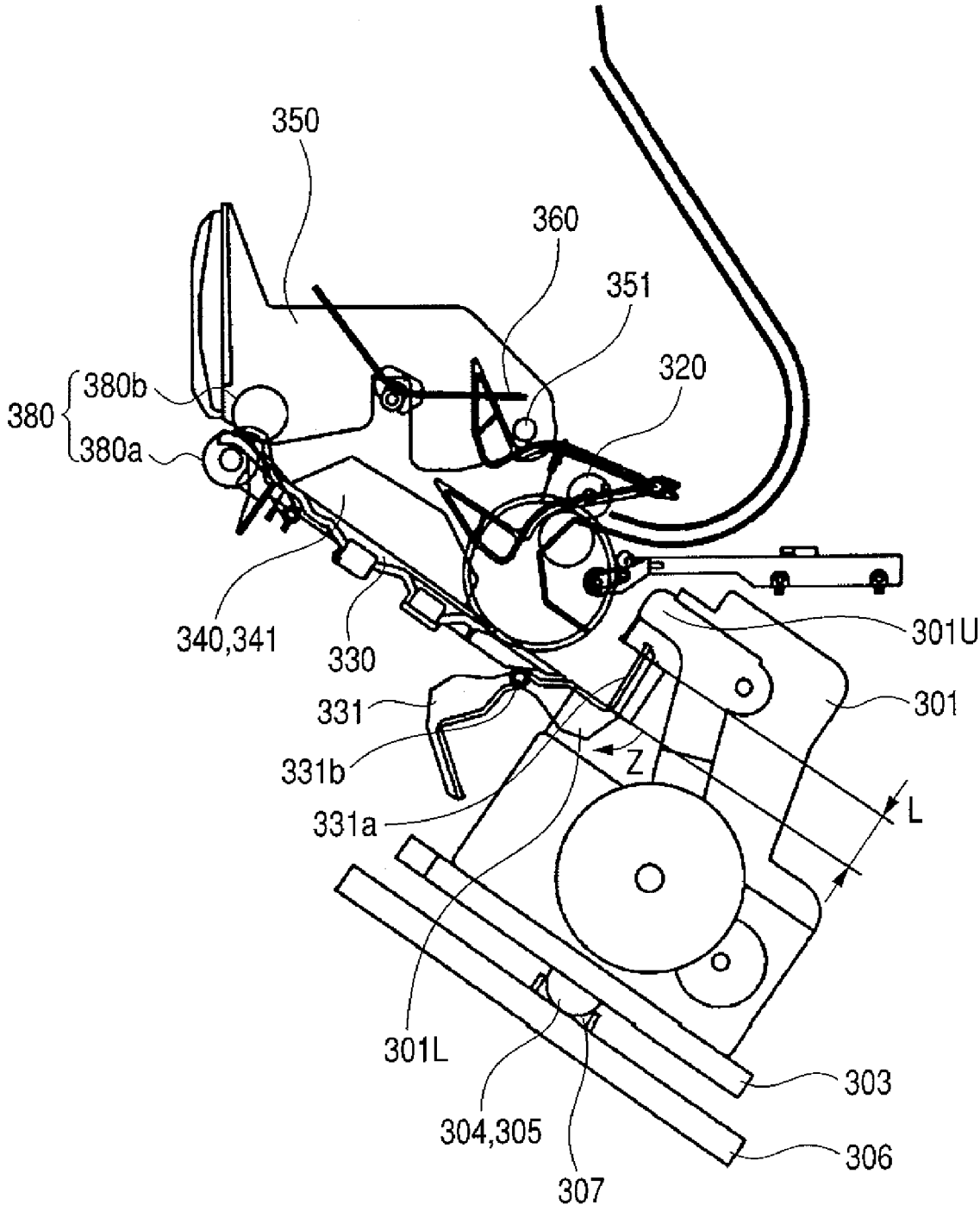
FIG. 3 is a schematic sectional view of the saddle stapling processing part in the sheet processing apparatus.

As shown in FIGS. 2 and 3, the stapler (stapling unit) 301 is fixed onto a slide support base 303. Rolling rollers 304, 305 engage with a lower portion of the slide support base 303 and are constructed to be guided along a guide rail groove 307 on a staple moving plate 306. With this arrangement, the stapler 301 moves substantially in parallel along the trailing edges of the sheets stacked on the processing tray 330. Note that the stapler 301 is, it follows, kept in a posture inclined at, as shown in FIG. 2, a predetermined angle $\alpha$ to the trailing edges of the sheets at the angular portions (the positions A and D) on the processing tray 330. In the present embodiment, the predetermined angle $\alpha$ can be, though set such as $\alpha$ □ 30°, changed by changing a shape of the guide rail groove 307.

Further, the stapling unit is provided with an unillustrated position sensor for detecting a home position of the stapler 301. This position sensor is provided on the staple moving plate 306. The stapler 301, of which the home position is set in the position A in FIG. 2 that corresponds to a position on the anterior side of the apparatus, stands by in this position A in a standby status such as during a stop of the apparatus. It is to be noted that the stapler 301 according to the present embodiment is capable of executing the stapling process by moving to the angular portions (the positions A and D) and to the back portions (the positions B and C) of the sheets in accordance with the setting.

Figure 4:
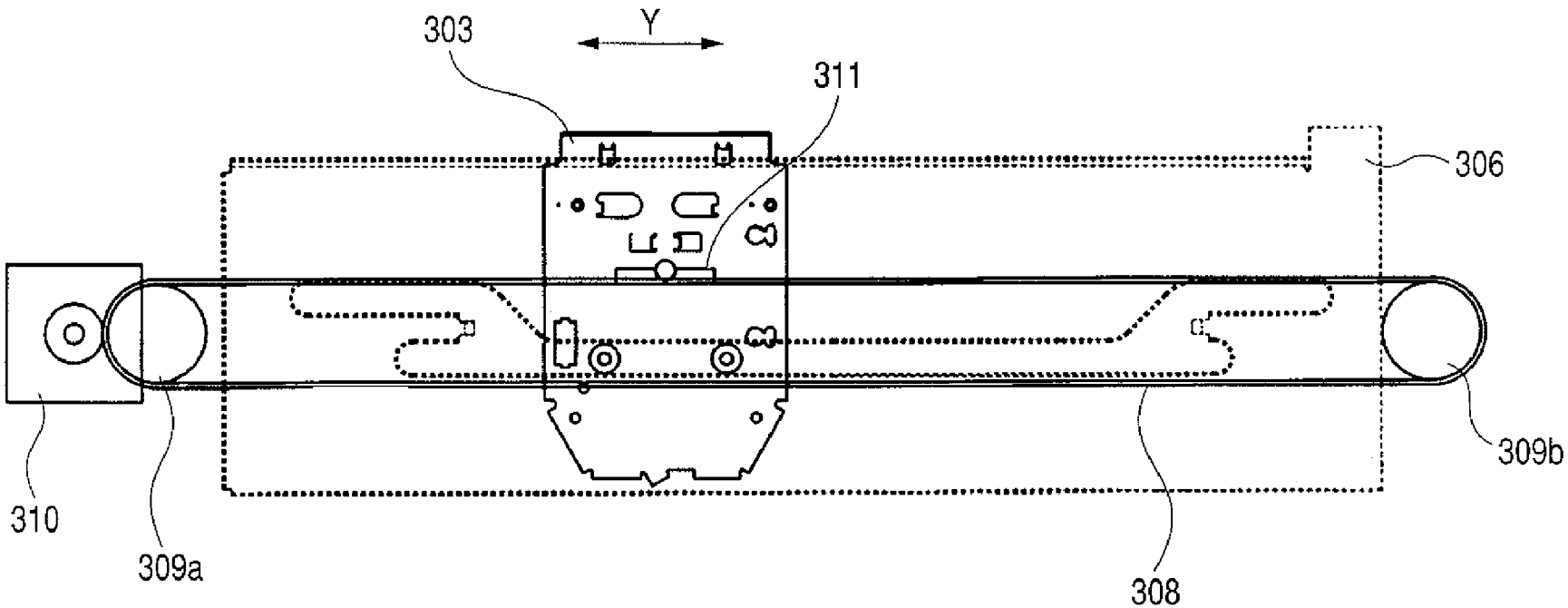
FIG. 4 is a schematic top view of a moving mechanism of a stapling unit in the saddle stapling processing part.
Figure 5A:
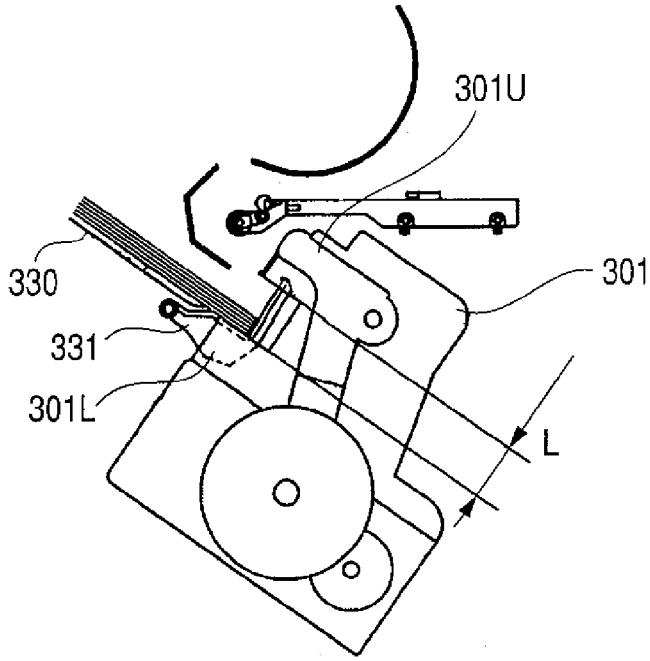
FIGS. 5A and 5B are schematic sectional views showing an opening distance of the stapler.
Figure 5B:
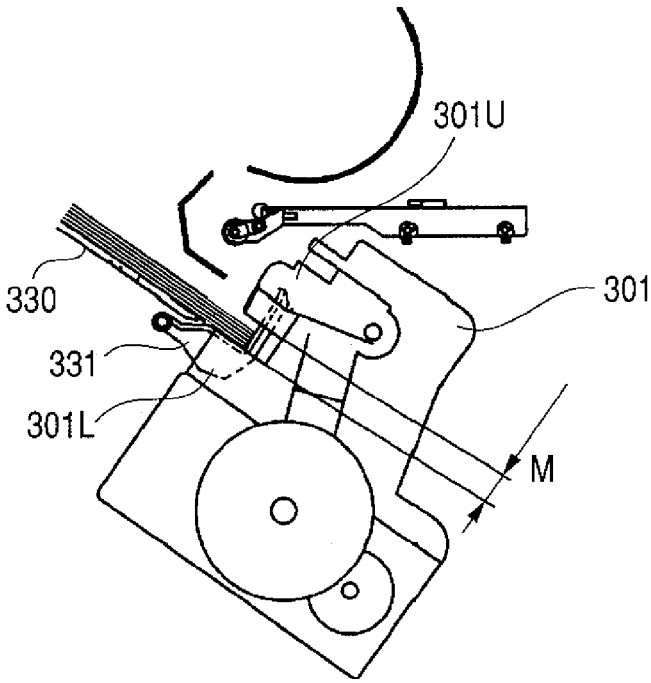

Next, a moving mechanism for moving the stapler 301 in an arrowhead direction Y will be described by use of FIG. 4. The moving mechanism of the stapler 301 has a drive motor 310 rotatable in the forward and reversed directions and a moving belt 308 looped round belt pulleys 309*a*, 309*b* rotated by the drive motor 310. The moving belt 308 engages with a belt support part 311 provided at the lower portion of the slide support base 303. With this configuration, the moving belt 308 is rotated with the rotations of the drive motor 310 in the forward and reversed directions, whereby the stapler 301 moves in the arrowhead direction Y together with the moving belt 308.

Next, a processing tray unit including the processing tray 330 will be explained by use of FIGS. 2 and 3.

The processing tray unit is constructed of the processing tray 330, a trailing edge stopper 331, edge aligning members 340, 341 provided on the processing tray 330 at both sides of a sheet, a swing guide 350, a pull-in paddle 360 and the bundle discharge rollers 380.

The processing tray 330 is set in a state of being inclined downward but toward the upstream side (the right side in FIG. 3) from the downstream side (the left side in FIG. 3) in the discharging direction of the sheet bundle. The trailing edge stopper 331 is disposed at the upstream side end portion of the processing tray 330. Further, the edge aligning members 340, 341 are disposed at a middle portion of the processing tray 330. Moreover, the pull-in paddle 360 and the swing guide 350 are disposed in an upper area portion of the processing tray 330.

Note that the trailing edge stopper 331 has, as illustrated in FIG. 3, a butting support face 331*a* that butts against and thus supports the trailing edge of the sheet P, and is so constructed as to be swingable in an arrowhead direction Z about a support pin 331*b* on the side of the undersurface of the processing tray 330.

In the present embodiment, the trailing edge stoppers 331 are, as depicted in FIG. 2, provided in four positions (331A, 331B, 331C, 331D in FIG. 2) and are each so supported as to be solely swingable. The respective trailing edge stoppers 331A to 331D, in predetermined positions (A, B, C, D in FIG. 2) of the stapler 301, function in positions to enter (approach) a clinch area (where the sheet bundle is clinched). Therefore, if the trailing edge stopper existing in the stapling position of the stapler 301 remains in the position for butting against the trailing edges of the sheets, it follows that the trailing edge stopper is caught by the clinch of the stapler 301. Such being the case, for preventing this phenomenon, only the trailing edge stopper existing in the stapling position of the stapler 301 is retreated in the arrowhead direction Z, while the remaining three trailing edge stoppers butt against the trailing edges of the sheets P arriving at on the processing tray 330. Referring to, for example, FIG. 2, in such a case that the stapler 301 conducts the stapling process in the position A, only the trailing edge stopper 331A takes a position retreated off the clinch area (in the arrowhead direction Z), while the remaining three trailing edge stoppers 331B, 331C, 331D butt against and thus support the trailing edges of the sheets P.

Then, the sheets P discharged into the processing tray 330 from the first discharge rollers 320 are butted in their trailing edges against the butting support face 331*a* of the trailing edge stopper 331 by dint of a self-weight and action of the pull-in paddle 360. Further, the sheets P are aligned in their bilateral (right and left) edges (which are the edges in a widthwise direction orthogonal to the sheet conveying direction) by the edge aligning members 340, 341. With this operation, the sheets accommodated on the processing tray 330 are sequentially aligned and are thereby stacked into one sheet bundle.

Furthermore, one lower discharge roller 380*a* constituting the bundle discharge rollers 380 is disposed at the downstream side end portion of the processing tray 330. Still further, the other upper discharge roller 380*b*, on which the lower bundle discharge roller 380*a* abuts in a separable/closable manner, is disposed at the undersurface front end portion of the swing guide 350. These discharge rollers 380*a*, 380*b* are constructed so as to be rotatable by the drive motor in the forward and reversed directions.

The swing guide 350 is so drive-controlled as to be swingable about a support shaft 351, and a home position thereof corresponds to a closing state where the upper bundle discharge roller 380*b* abuts on the lower bundle discharge roller 380*a*. Then, when the sheets P are discharged onto the processing tray 330, the bundle discharge roller pair 380 shifts to an opening state. This opening state is a state where the upper bundle discharge roller 380*b* separates from the lower bundle discharge roller 380*a* due to an upward swing of the swing guide 350. Then, when the sheet bundle, which finishes undergoing the process on the processing tray 330, is discharged onto the stack tray 622, the bundle discharge roller pair 380 shifts to the closing state. This closing state is a state where the upper bundle discharge roller 380*b* and the lower bundle discharge roller 380*a* cooperate to pinch the sheet bundle due to a downward swing of the swing guide 350. Alternatively, in the case of having no sheet bundle, the closing state represents a state in which the upper bundle discharge roller 380*b* abuts on the lower bundle discharge roller 380*a*.

Given next is a detailed explanation about a series of side stapling processes by the stapling unit of the side stapling processing portion 300.

The stapler 301 previously stands by in a desired clinch position (which is any one of the stapling positions A-D shown in FIG. 2) for the sheet bundle, corresponding to a stapling mode (which is a one-point stapling mode or a two-point stapling mode in the present embodiment). Then, the stapler 301, at a point of time when the last sheet P of the bundle is completed in its discharging and aligning, staples this sheet bundle. It should be noted that the stapling unit according to the present embodiment is capable of the stapling process corresponding to the stapling mode (the one-point stapling mode of executing the stapling process at one point of the angular portion of the sheet bundle, and the two-point stapling mode of executing the stapling process at two points of the back portion of the sheet bundle), however, the following discussion will exemplify the one-point stapling mode).

Herein, a configuration of the stapler 301 will be explained. As shown in FIG. 3, the stapler 301 is constructed of a clincher 301U defined as a first stapling part and disposed on an upper side and of a driver 301L defined as a second stapling part and disposed on a lower side. At first, in the stapler 301, the clincher 301U descends toward the driver 301L fixed to the apparatus, wherein the sheet bundle is pinched by a staple needle projecting from the driver 301L and by the clincher 301U. Further, when the clincher 301U descends, the staple needle projecting from the driver 301L penetrates the entire sheets of the sheet bundle. Then, when the clincher 301U further descends, the staple needle is clinched along a shape of the clincher 301U (which is, e.g., a shape of a groove bent inward) so as to hold the sheet bundle while bending inward an edge portion of the staple needle, thereby stapling the sheet bundle. After finishing the clinch of the staple needle, the clincher 301U again ascends. The stapler 301 gets ready for the next clinch operation in a state of keeping an opening distance L between the clincher 301U and the driver 301L. The opening distance L is defined as an effective distance between the surface of the clincher 301U and the front end of the driver 301L. The opening distance L differs depending on conditions (which will hereinafter be termed stapling conditions) such as the number of sheets of the sheet bundle, a bundle thickness and a sheet curl quantity. In the present embodiment, the opening distance L is determined in accordance with the stapling conditions such as the number of sheets of stapling sheet bundle, the sheet curl quantity and an air layer between the sheets. To be specific, the opening distance L is set to 30 mm through 35 mm in a way that takes into consideration the number of sheets of stapling sheet bundle (=100 sheets), the sheet curl quantity (=10 mm) and the air layer between the sheets.

FIRST EMBODIMENT

Next, the process in the case of selecting the one-point stapling mode in setting the stapling mode described above will be explained with reference to FIGS. 2, 5A, 5B and 6. On the occasion of the one-point stapling mode, the predetermined stapling position (which is any one of the positions A and D) of the sheet bundle is stapled by the clinch operation of the stapler 301. Thereafter, the swing guide 350 performs the closing operation, and the sheet bundle is discharged with the forward rotations of the pair of bundle discharge rollers 380 and is thereby stacked on the stack tray 622.

Figure 6:
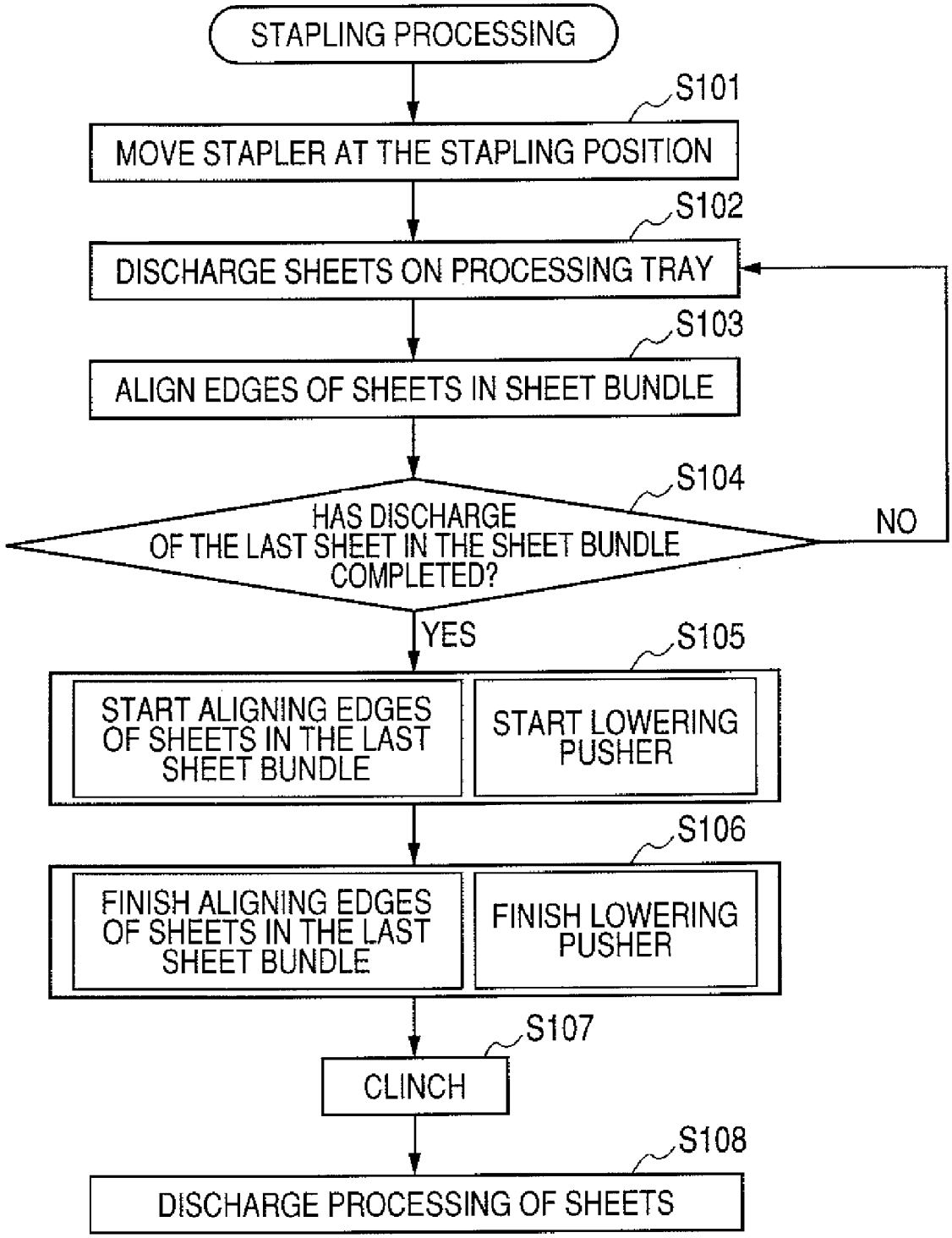
FIG. 6 is a flowchart showing an operation flow when executing a stapling process.

To start with, when the one-point stapling mode is selected, the stapler 301 moves, as depicted in FIG. 6, to the predetermined stapling position (which is any one of the positions A and D in FIG. 2 in the present embodiment) of the sheet bundle (S101) Then, the sheets are discharged onto the processing tray 330 and sequentially aligned in their edges (S102, S103). During this aligning operation, the stapler 301 stands by in the predetermined stapling position (which is any one of the positions A and D in FIG. 2). At this time, the stapler 301 stands by with the opening distance (a first opening distance) L between the stapling parts 301U and 301L described above. Hence, when aligning the edges of the sheets discharged onto the processing tray 330, even if the sheet edges are, e.g., curled, the sheets enter between the stapling parts 301U and 301L without the sheet edges being caught by the clincher 301U of the stapler 301.

When the last sheet of the sheet bundle is discharged onto the processing tray 330 (S104), the aligning process of this last sheet is started (S105). The last sheet discharged onto the processing tray 330, at first, butts in its trailing end against the trailing edge stopper 331 by dint of the action of the pull-in paddle 360 etc. Subsequently, the edge aligning members 340, 341 start the operation of aligning the sheet edges in the sheet widthwise direction. Upon the start of the operation of aligning the sheet edges in the sheet widthwise direction, in synchronization with this operation, the clincher 301U of the stapler 301 starts descending in order to make the opening distance of the stapler 301 narrower than the first opening distance L (S105). Namely, the stapler 301 stands by in the predetermined stapling position (which is any one of the positions A and D in FIG. 2) in the state of keeping the first opening distance L till the trailing end of the last sheet discharged onto the processing tray 330 butts against the trailing edge stopper 331. Then, during the operation of aligning the sheet edge in the widthwise direction of the last sheet, the clincher 301U of the stapler 301 starts descending.

Then, the edge aligning members 340, 341 finish aligning the sheet edge in the widthwise direction of the last sheet (S106). Further, till the edge aligning members 340, 341 finish the sheet alignment, the clincher 301U of the stapler 301 also finishes descending (S106). With this operation, the stapler 301, before the stapling operation in the predetermined stapling position (which is any one of the positions A and D in FIG. 2), is held with a second opening distance M narrower than the first opening distance L (M<L). Then, the stapler 301 clinches the sheet bundle from the position with the second sheet opening distance M narrowed before the stapling operation, whereby the sheet bundle is stapled by needle (S107). The needle-stapled sheet bundle is discharged onto the stack tray by the bundle discharge roller pair (S108).

In the first embodiment, the descent position down to the second opening distance M of the stapler 301 is controlled in a way that counts the number of rotational pulses of a clinch motor that drives a cam mechanism from the home position detected by employing the sensor provided within the stapler 301. Further, the second opening distance M is determined corresponding to an output waveform of the clinch motor within the stapler 301. Namely, a bundle thickness of the sheet bundle is detected from electric power consumption (a load by the needle stapling), and hence the second opening distance M corresponding to the bundle thickness can be set. The control described above is conducted based on a result of computing in the CPU circuit part 150.

It is to be noted that the second opening distance M before the stapling operation differs depending on the stapling conditions such as the bundle thickness of the sheet bundle and the number of sheets of the sheet bundle, and is controlled based on a value determined beforehand in conformity with the stapling conditions. Generally, a relationship such as $M_L > M_S$ is established, where $M_L$ is the opening distance when the bundle thickness or the number of sheets of the sheet bundle is large, and, by contrast, $M_S$ is the opening distance when the bundle thickness or the number of sheets of the sheet bundle is small.

As discussed above, the reason why the second opening distance M of the stapler 301 can be set narrower than the first opening distance L during the operation of aligning the edge of the last sheet by the edge aligning members 340, 341, is that the sheet bundle including the last sheet is in the state where the trail end of the sheet bundle has already entered between the clincher 301U and the driver 301L. Therefore, even if in such a state that the trail end of the sheet is largely curled, it does not happen that the sheet trailing end collides with the driver to cause de-alignment. From these reasons, before starting the stapling operation, the driver 301L is descended during the operation of aligning the edge of the last sheet by the edge aligning members 340, 341, whereby the second opening distance M can be set narrower than the first opening distance L. Moreover, the second opening distance M can be narrowed down to a minimum opening distance corresponding to the stapling conditions described above.

As discussed above, the sheet processing time required for the needle-stapling can be reduced by controlling the position of the opening distance of the stapler 301. The time required for the needle-stapling can be thus reduced, and hence the productivity of the whole image forming apparatus can be improved.

Specifically, the embodiment discussed above will verify an effect on the occasion of making 50 or 100 sheet bundles, wherein a single sheet bundle consisting of, e.g., 100 sheets is subjected to the one-point stapling process. Note that the opening distance of the sheet bundle consisting of 100 sheets is set to 12 mm trough 13 mm. In this case, one-point clinch time TD (the opening distance L=13 mm) was 150 ms (=0.15 sec). In contrast with this, if remaining under the conventional control that does not narrow the opening distance of the stapler 301, one-point clinch time TO (the opening distance=30 mm) was 400 ms (=0.4 sec). Therefore, according to the first embodiment, as compared with the conventional comparative example, the processing time required for the one-point stapling of the single sheet bundle is reduced by 250 ms (=0.25 sec). Hence, the processing time can be reduced by approximately 12.5 sec in the case of making the 50 sheet bundles and can be reduced by 25 sec in the case of making the 100 sheet bundles.

Thus, according to the first embodiment, it is possible to reduce the time required for the stapling process and to improve the productivity simply by performing the position control to narrow the opening distance of the stapler during the operation of aligning the edge of the last sheet without scaling up the apparatus, causing any complicated configuration of the apparatus and increasing the costs.

Further, according to the first embodiment, the opening distance before the stapling operation is narrowed down to the minimum opening distance enabling the stapling operation in accordance with the stapling conditions such as the number of sheets of the sheet bundle and the bundle thickness. With this contrivance, when the sheet bundle consists of a small number of sheets and when the sheet is comparatively thin, the productivity can be further improved.

It should be noted that the first embodiment discussed above has exemplified in its explanation the one-point stapling in terms of the number of stapling points on the single sheet bundle, however, the present invention is effective in even plural-point stapling, i.e., two- or more-point stapling. In the case of executing the two- or more-point stapling process on the single sheet bundle, the clincher 301U ascends after finishing the clinch operation at the first point, however, it is more preferable to get ready for the next clinch operation in a state of keeping the second opening distance M with respect to the driver 301L. This contrivance enables not only the reduction of the time required for the stapling process at each stapling point irrespective of the number of points for the stapling process but also a further reduction of the time required for the stapling process and a further improvement of the productivity.

Moreover, the first embodiment discussed above has exemplified the stapler of such a type that the clincher 301U is movable, however, the present invention is not limited to this type. For instance, the stapler of such a type that only the driver 301L is movable may be available, or alternatively the stapler of such a type that both of the clincher 301U and the driver 301L are movable may also be available, wherein the same effect can be acquired. Still further, the clincher 301U and the driver 301L may be inverted in their dispositions in the vertical direction.

The first embodiment discussed above has exemplified the configuration in which the present invention is applied to the side stapling process in the finisher 600, however, the present invention is not limited to this configuration. For example, the present invention is applied to even the saddle stapling processing portion in the finisher 600, wherein the same effect can be obtained.

Still further, the first embodiment discussed above has exemplified the copying machine as the image forming apparatus, however, the present invention is not limited to the copying machine. Other image forming apparatuses such as a printer and a facsimile apparatus may also be available. Alternatively, other image forming apparatuses such as a multifunction machine having a combination of functions of these apparatuses may also be available. The same effect can be acquired by applying the present invention to the sheet processing apparatus employed in these image forming apparatuses.

Yet further, the first embodiment discussed above has exemplified the sheet processing apparatus that is detachably attachable to the image forming apparatus main body, however, the present invention is not limited to this type of sheet processing apparatus. For instance, the sheet processing apparatus integrally included in the image forming apparatus may also be available, wherein the same effect can be obtained by applying the present invention to this type of sheet processing apparatus.

SECOND EMBODIMENT

Next, the process in the case of selecting the two-point stapling mode in setting the stapling mode described above will be explained with reference to FIGS. 2, 5 and 8.

Figure 8:
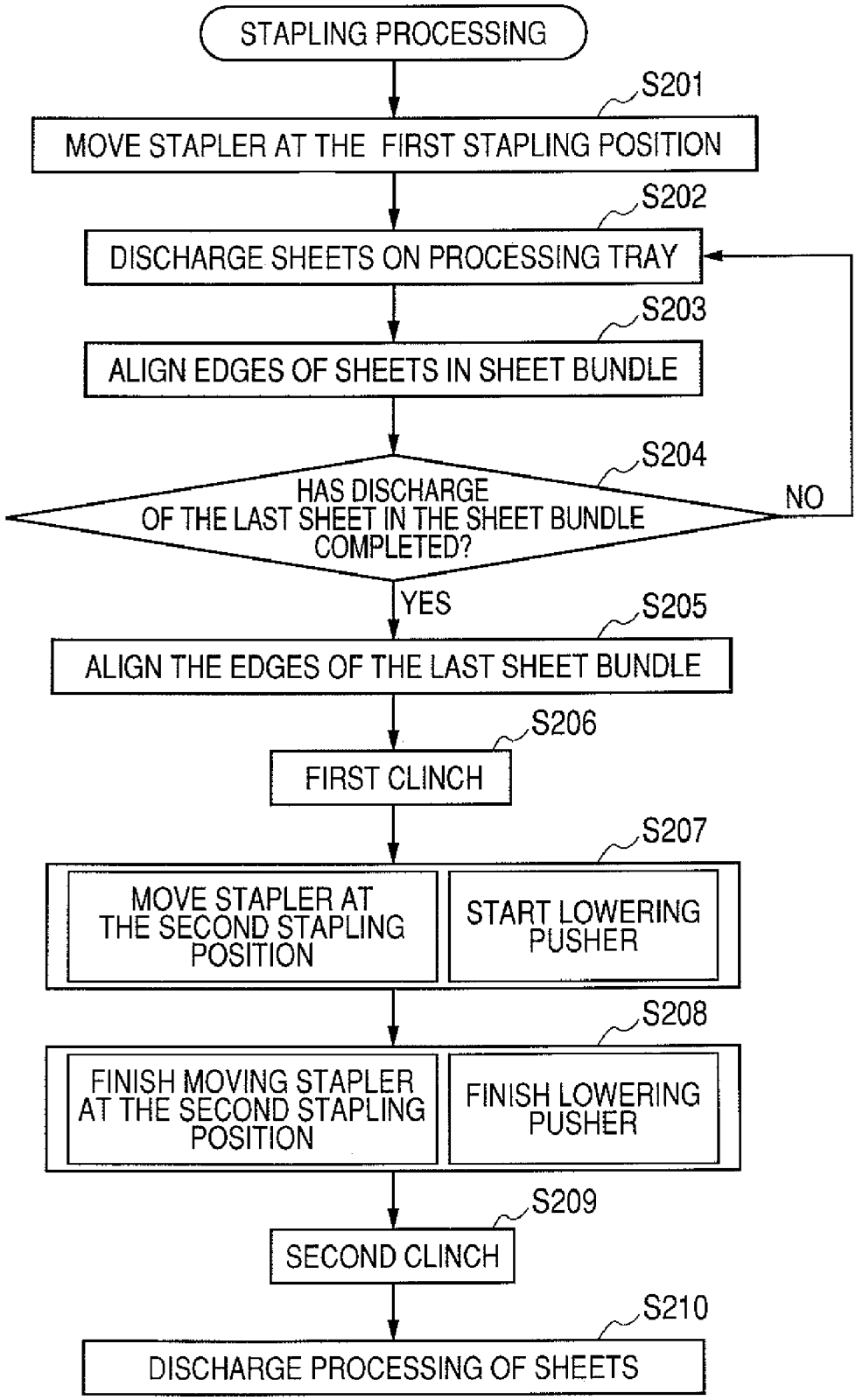
FIG. 8 is a flowchart showing an operation flow when executing two-point stapling process.

At first, when selecting the two-point stapling mode, the stapler 301, as shown in FIG. 8, moves to the first stapling position (the stapling position B illustrated in FIG. 2) defined as the needle stapling position at the first point (S201). Then, the sheets are discharged onto the processing tray 330 and sequentially aligned in their edges (S202, S203). During this aligning operation, the stapler 301 stands by in the first stapling position B (see FIG. 2). At this time, the stapler 301 stands by with the opening distance L between the stapling parts 301U and 301L. When the last sheet is discharged onto the processing tray 330 and aligned in its edge (S204), one sheet bundle with the sheets aligned and bundled (stacked) is made (S205). Then, after finishing the alignment, the stapler 301 standing by in the first stapling position B clinches the sheet bundle from the position of the opening distance L, thereby needle-stapling the sheet bundle at the first point (S206). It should be noted that in the second embodiment, the needle-stapling operation by the stapler 301 is performed in such a way that the clincher 301U is descended by an unillustrated clinch motor and a cam mechanism, and clinches the sheet bundle together with the driver 301L.

After completing the needle-stapling at the first point, the stapler 301 starts moving (in an arrowhead direction k) to the second stapling position (which is the stapling position C shown in FIG. 2) defined as the needle-stapling position at the second point, along the trailing edge of the sheet (S207). Simultaneously, for setting the opening distance between the stapling parts 301U and 301L before the stapling operation at the second point narrower than the opening distance before the stapling operation at the first point, the clincher 301U of the stapler 301 starts descending (S207). The stapler 301 temporarily completes the needle-stapling at the first point in the state of keeping the opening distance L in the first stapling position B, however, the clincher 301U starts descending during the movement to the second stapling position C.

Then, the stapler 301 finishes moving to the second stapling position C (S208). Simultaneously, the clincher 301U of the stapler 301 finishes descending (S208). With this operation, the stapler 301 before the stapling operation in the second stapling position C is held with the opening distance M narrower than the opening distance L between the stapling parts 301U and 301L before the stapling operation at the first point (M<L). Then, the stapler 301 moved to the second stapling position C clinches the sheet bundle from the position of the opening distance M narrowed before the stapling operation at the second point, thereby needle-stapling the sheet bundle at the second point (S209). The sheet bundle undergoing the needle-stapling is discharged onto the stack tray by the bundle discharge roller pair (S210).

In the second embodiment, the descent position down to the second opening distance M of the stapler 301 is controlled in a way that counts the number of rotational pulses of the clinch motor that drives the cam mechanism from the home position detected by employing the sensor provided within the stapler 301. Further, the opening distance M is determined corresponding to the output waveform of the clinch motor within the stapler 301. Namely, the bundle thickness of the sheet bundle is detected from the electric power consumption (the load by the needle stapling), and hence the second opening distance M corresponding to the bundle thickness can be set. The control described above is conducted based on the result of computing in the CPU circuit part 150.

With respect to the opening distance M before the stapling operation at the second point, a relationship such as $M_L > M_S$ is established, where $M_L$ is the opening distance when the number of sheets of the sheet bundle or the bundle thickness is large, and, by contrast, $M_S$ is an opening distance when the number of sheets of the sheet bundle or the bundle thickness is small. Further, the number of sheets of the sheet bundle or the bundle thickness and the electric power (the load) of the clinch motor within the stapler 301 for stapling this sheet bundle take a proportional relationship with each other. Accordingly, the bundle thickness of the sheet bundle can be detected from the output waveform (the electric power consumption) of the clinch motor at the first point. Then, the opening distance M at the second point can be set, based on this detection information, narrow down to the minimum opening distance enabling the sheet bundle to be stapled.

The following is a reason why, as described above, till before the stapling operation at the second point, the opening distance M of the stapler 301 can be set narrower than the opening distance L at the first point and also can be set narrow down to the stabling-enabled minimum opening distance. At first, it is because, in the sheet bundle undergoing the needle-stapling at the first point, the air layer between the sheets is eliminated, and the sheet bundle thickness gets smaller than before the air layer is eliminated. Further, the sheet bundle undergoing the needle-stapling at the first point is in a state where the trailing edge of the sheet bundle has already entered (approached) between the clincher 301U and the driver 301L. Therefore, even if in such a state that the trail end of the sheet is largely curled, it does not happen that the sheet trailing end collides with the driver to cause de-alignment. From these reasons, the driver 301L is descended during the movement of the stapler 301 to the second stapling position, whereby the opening distance can be narrowed down to the minimum opening distance.

Note that the position control of the opening distance of the stapler 301 is not limited to the control based on counting the number of rotational pulses of the clinch motor described above. For instance, such a configuration may also be taken that each opening distance is detected by providing a position sensor for detecting the opening distance of the stapler 301.

As explained above, the position control of the opening distance of the stapler 301 is conducted, thereby decreasing the clinch time at the second point and the sheet processing time required for the needle-stapling at the plurality of points. Thus, the time required for the needle-stapling at the plurality of points can be reduced, and hence the productivity of the whole image forming apparatus can be improved.

To be specific, the embodiment discussed above will verify an effect on the occasion of making 500 sheet bundles, wherein a single sheet bundle consisting of, e.g., 100 sheets is subjected to the two-point stapling process. Note that the opening distance M of the sheet bundle consisting of 100 sheets at the second point is set to 12 mm trough 13 mm. In this case, the clinch time T1 at the first point (the opening distance L=35 mm) was 400 ms (=0.4 sec), the clinch time T2 at the second point (the opening distance M=13 mm) was 148 ms (□0.15 sec), and the moving time TM from the first point to the second point was 1000 ms (=1 sec). Namely, the processing time required for the needle-stapling at the two points was 1548 ms (□1.5 sec). By contrast, if remaining under the conventional control that does not narrow the opening distance of the stapler 301, the processing time required for the needle-stapling at the two points was 1800 ms (=1.8 sec). Hence, according to the second embodiment, as compared with the conventional comparative example, the processing time required for the two-point stapling of the single sheet bundle is reduced by 300 ms (=0.3 sec). When making the 500 sheet bundles, the processing time is reduced by 2.5 min.

Thus, according to the second embodiment, it is possible to reduce the time required for the stapling process at the plurality of points and to improve the productivity simply by performing the position control to narrow the opening distance during the movement of the stapler to the stapling position without scaling up the apparatus, causing any complicated configuration of the apparatus and increasing the costs.

Further, according to the second embodiment, the opening distance before the stapling operation from the second point onward is narrowed down to the minimum opening distance enabling the stapling operation in accordance with the stapling conditions such as the number of sheets of the sheet bundle and the bundle thickness. With this contrivance, when the sheet bundle consists of a small number of sheets and when the sheet is comparatively thin, the productivity can be further improved.

Still further, according to the second embodiment, the bundle thickness is detected based on the output waveform (the electric power consumption) of the clinch motor within the stapler 301, and the opening distance before the stapling operation from the second point onward is narrowed down to the minimum opening distance enabling the stapling operation. This contrivance enables a further improvement of the productivity when the sheet bundle consists of a small number of sheets and when the sheet is comparatively thin. Moreover, the position with respect to the opening distance is controlled each time corresponding to counting the number of rotational pulses, and therefore the more proper position control can be attained It should be noted that the second embodiment discussed above has exemplified the stapler of such a type that the clincher 301U is movable, however, the present invention is not limited to this type. For instance, the stapler of such a type that only the driver 301L is movable may be available, or alternatively the stapler of such a type that both of the clincher 301U and the driver 301L are movable may also be available, wherein the same effect can be acquired.

Moreover, the second embodiment discussed above has exemplified the two-point case in terms of the number of stapling points as the plural-point stabling process, however, the same operation can be performed even when the number of stapling points is 3 or more, wherein the time required for the stapling process can be further reduced.

Furthermore, the second embodiment discussed above has exemplified the configuration in which the present invention is applied to the side stapling process in the finisher 600, however, the present invention is not limited to this configuration. For example, the present invention is applied to even the saddle stapling processing portion in the finisher 600, wherein the same effect can be obtained. Note that in this case, one pair of staplers of the saddle stapling processing portion described above shall be prepared, and the pair of staplers shall move in the sheet widthwise direction, whereby the sheet bundle shall undergo the stapling process at the plurality of points.

Still further, the second embodiment discussed above has exemplified the copying machine as the image forming apparatus, however, the present invention is not limited to the copying machine. Other image forming apparatuses such as a printer and a facsimile apparatus may also be available. Alternatively, other image forming apparatuses such as a multi-function machine having a combination of functions of these apparatuses may also be available. The same effect can be acquired by applying the present invention to the sheet processing apparatus employed in these image forming apparatuses.

Yet further, the second embodiment discussed above has exemplified the sheet processing apparatus that is detachably attachable to the image forming apparatus main body, however, the present invention is not limited to this type of sheet processing apparatus. For instance, the sheet processing apparatus integrally included in the image forming apparatus may also be available, wherein the same effect can be obtained by applying the present invention to this type of sheet processing apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2005-233522, filed Aug. 11, 2005, 2005-233521, filed Aug. 11, 2005, 2006-180903, filed Jun. 30, 2006 and 2006-180904, filed Jun. 30, 2006, which are hereby incorporated by reference herein in their entirety.

What is claimed is:

1. A sheet processing apparatus comprising:

a stapling unit which staples a sheet bundle by clinching the sheet bundle with the use of a first stapling part and a second stapling part, of which sheets sequentially enter an opening between the first stapling part and the second stapling part;

an aligning member which aligns the sheets entering said opening; and a controller which controls said stapling unit so as to change an opening distance of said opening between said stapling parts, wherein said controller controls said stapling unit to stand by with a first opening distance till the last sheet of the sheet bundle enters said opening, and then changes the opening distance into a second opening distance, narrower than the first opening distance.

2. A sheet processing apparatus according to claim 1, wherein said controller changes the second opening distance, corresponding to stapling conditions such as the number of sheets of the sheet bundle.

3. A sheet processing apparatus according to claim 2, wherein said controller sets the second opening distance to a minimum opening distance enabling the stapling operation under the stapling conditions.

4. A sheet processing apparatus according to claim 1, wherein said controller changes the opening distance into the second opening distance till said aligning member finishes the operation of aligning the last sheet.

5. An image forming apparatus comprising:

an image forming part which forms an image on a sheet;

a sheet processing apparatus which performs a process on the sheet formed with the image; and a controller which controls said sheet processing apparatus, said sheet processing apparatus comprising:

a stapling unit which staples a sheet bundle by clinching the sheet bundle with the use of a first stapling part and a second stapling part, of which sheets sequentially enter an opening between the first stapling part and the second stapling part, said controller controls said stapling unit so as to change an opening distance of said opening between said stapling parts; and an aligning member which aligns the sheets entering said opening, wherein said controller controls said stapling unit to stand by with a first opening distance till the last sheet of the sheet bundle enters said opening, and changes the opening distance into a second opening distance, narrower than the first opening distance.

6. An image forming apparatus according to claim 5, wherein said controller changes the second opening distance, corresponding to stapling conditions such as the number of sheets of the sheet bundle.

7. An image forming apparatus according to claim 6, wherein said controller changes the second opening distance to a minimum opening distance enabling the stapling operation under the stapling conditions.

8. An image forming apparatus according to claim 5, wherein said controller changes the opening distance into the second opening distance till said aligning member finishes the operation of aligning the last sheet.

* * * * *